US009020379B2

(12) United States Patent
Saito

(10) Patent No.: US 9,020,379 B2
(45) Date of Patent: Apr. 28, 2015

(54) IMAGE FORMING APPARATUS CONTROLLING LIGHT EXPOSURE BASED ON APPLIED BIAS

(71) Applicant: Canon Kabushiki Kaisha, Tokyo (JP)

(72) Inventor: Makoto Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 13/857,159

(22) Filed: Apr. 5, 2013

(65) Prior Publication Data

US 2013/0287417 A1 Oct. 31, 2013

(30) Foreign Application Priority Data

Apr. 27, 2012 (JP) ..... 2012-103005

(51) Int. Cl.
*G03G 15/00* (2006.01)
*G03G 15/16* (2006.01)
*G03G 15/01* (2006.01)

(52) U.S. Cl.
CPC ..... *G03G 15/1675* (2013.01); *G03G 15/0131* (2013.01); *G03G 15/5058* (2013.01); *G03G 2215/0158* (2013.01)

(58) Field of Classification Search
USPC ..... 399/49, 66
See application file for complete search history.

(56) References Cited

U.S. PATENT DOCUMENTS

| | | | | |
|---|---|---|---|---|
| 6,564,021 | B1 | 5/2003 | Nakai et al. | |
| 7,385,737 | B2 | 6/2008 | Zaima | |
| 7,444,090 | B2 * | 10/2008 | Nishida et al. | 399/49 |
| 2010/0150590 | A1 | 6/2010 | Yoshino | |

FOREIGN PATENT DOCUMENTS

| | | | |
|---|---|---|---|
| JP | 2001-166558 | A | 6/2001 |
| JP | 2002-156846 | A | 5/2002 |
| JP | 2003-202711 | A | 7/2003 |
| JP | 2010-145585 | A | 7/2010 |

* cited by examiner

*Primary Examiner* — William J Royer
(74) *Attorney, Agent, or Firm* — Fitzpatrick, Cella, Harper & Scinto

(57) ABSTRACT

When a toner image formed on the surface of a photosensitive drum is transferred onto an intermediate transfer belt, a transfer bias is applied to a primary transfer portion. When a patch formed in an upstream image forming station and transferred onto the intermediate transfer belt and a patch formed on the surface of the photosensitive drum pass through the primary transfer portion, a passing bias different from the transfer bias is applied to the primary transfer portion. A control section controls a laser beam scanner as an exposure member not to expose the surface of the photosensitive drum to which the passing bias is applied.

7 Claims, 7 Drawing Sheets

IMAGE FORMING APPARATUS CONTROLLING LIGHT EXPOSURE BASED ON APPLIED BIAS

BACKGROUND OF THE INVENTION

1. Field of the Invention

The present invention relates to an image forming apparatus using electrophotography or electrostatic recording, such as a copying machine, a printer, a facsimile machine, or a complex machine of these applications, and particularly to a structure for forming, on an image bearing member, a toner image used for adjustment.

2. Description of the Related Art

Conventionally, for example, in an electrophotographic image forming apparatus, an electrostatic image (latent image) formed on an electrophotographic photoreceptor as an image bearing member is developed with toner to form a toner image. After that, the toner image formed on the photoreceptor is eventually transferred and fixed onto a recording material (recording sheet, OHP sheet, or the like), and output to the outside of the image forming apparatus. As a system for transferring the toner image on the photoreceptor to the recording material, there is an intermediate transfer system in which the toner image formed on the photoreceptor is once transferred onto an intermediate transfer member and the toner image on this intermediate transfer member is transferred onto the recording material. Further, as the intermediate transfer system, there is known a tandem structure in which multiple image forming stations are lined up in the rotational direction of the intermediate transfer member to superimpose and transfer each color toner image formed in each image forming station sequentially onto the intermediate transfer member.

As described in Japanese Patent Application Laid-Open No. 2003-202711, there is known a density correction technique in which a toner image for adjustment (hereinafter called a patch) is formed on a photoreceptor or an intermediate transfer member to have a predetermined density, and the patch density is detected to perform feedback on imaging conditions according to the degree of the patch density. There is also known a technique in which relative position of patches for respective color components is detected to correct registration errors among respective color components.

In the meantime, as for the detection of the density and position of a patch (patch detection) as mentioned above, it is conceivable that, in an image forming apparatus for forming a multicolor image, all the multiple colors are formed together on an intermediate transfer member and read on the intermediate transfer member together. However, the intermediate transfer member varies in surface roughness and surface color with long-term use, and this may cause a substrate signal of the intermediate transfer member to fluctuate a lot. For example, the surface roughness is increased by the adherence of a paper loading material, or the surface is whitened by the adherence of external additives for toner. When the substrate signal of the intermediate transfer member is unstable, since the toner density is calculated as a contrast with the substrate upon patch detection, the accuracy of detection is reduced in the case of a color having low contrast with the substrate (e.g., black).

On the other hand, it is also considered that the patch detection is made on a photoreceptor, which does not come into direct contact with a recording material. In this case, since there is no substance transferred from the recording material, the surface durability fluctuation is small compared with that of the intermediate transfer member. This is preferred in terms of the stability of the substrate signal. Therefore, it can be considered that the detection of a black patch that is especially low in brightness and easily influenced by substrate fluctuations is made on the photoreceptor and the detection of patches for bright color components such as magenta, cyan, and yellow are made on the intermediate transfer member.

When such a structure is applied to a tandem image forming apparatus, it is preferred to place a black image forming station in the most downstream position in order to shorten FCOT (First Copy Out Time) upon formation of an image in a plain color of black.

However, in such a structure, when other color patches formed in the upstream stations pass through a primary transfer portion for transferring a toner image from a black photoreceptor in the downstream station onto an intermediate transfer member, the other color patches can be retransferred onto the photoreceptor. When retransfer occurs, the accuracy of detection of the other color patches on the intermediate transfer member may be reduced.

For example, as illustrated in FIG. 9, when an ordinary transfer bias is applied upon transfer of a toner image from a photosensitive drum 1 as the photoreceptor onto an intermediate transfer belt 51 as the intermediate transfer member in a primary transfer portion T1, a discharge phenomenon occurs downstream of the primary transfer portion T1. Here, if the toner charge polarity is negative, since negatively charged toner is electrostatically transferred onto the intermediate transfer belt 51, a positive charge is injected from a primary transfer roller 6 as a primary transfer member into the intermediate transfer belt 51. Then, the intermediate transfer belt 51 is charged with positive polarity to transfer the negatively charged toner onto the intermediate transfer belt 51. At this time, since a large potential difference occurs in a gap between the photosensitive drum 1 downstream of the primary transfer portion T1 and the intermediate transfer belt 51, a discharge phenomenon occurs in the gap downstream of the primary transfer portion T1 after toner transfer.

When such a discharge phenomenon occurs, since charge transfer occurs to reduce the potential difference between the intermediate transfer belt 51 and the photosensitive drum 1, the positive charge moves from the intermediate transfer belt 51 toward the photosensitive drum 1. In this case, since the positive charge is shot into toner held on the intermediate transfer belt 51, the toner may be reversed to the positive polarity. This causes the toner positively reversed to move in the direction of the photosensitive drum 1. The above is a retransfer generation mechanism. Thus, when the primary transfer bias is positive polarity as polarity opposite to the toner charge polarity, the bias can be set low in the positive direction to reduce the retransfer of toner.

On the other hand, it can be considered that the bias to be applied is of negative polarity that is the same polarity as the polarity of toner to pass the toner image on the photosensitive drum 1 through the primary transfer portion T1 without being transferred onto the intermediate transfer belt 51. Even in this case, however, the retransfer of toner can occur as follows. Namely, when a negative charge is supplied from the primary transfer roller 6 to the intermediate transfer belt 51, it electrostatically repulses the negatively charged toner supplied to the primary transfer portion T1. The toner acts to flick the toner electrostatically from the intermediate transfer belt 51 toward the photosensitive drum 1. Therefore, when the primary transfer bias is of negative polarity that is the same polarity as the toner charge polarity, the bias can be set low in the negative direction to reduce the retransfer of toner.

Thus, in order to prevent a patch on the intermediate transfer member from being retransferred at a downstream station, a bias to be applied to the primary transfer portion needs to be changed from the ordinary transfer bias. However, if the bias is switched from the ordinary transfer bias to a bias for preventing retransfer, the state of the surface potential of the image bearing member downstream of the primary transfer portion is changed. Then, when image formation is performed by using a portion where the state of the surface potential is changed, an image to be formed may be affected.

This point will be described below. As mentioned above, when an electric discharge occurs downstream of the primary transfer portion, the behavior of the positive charge to shoot into toner is seen, and the behavior of the positive charge to shoot into the surface of the image bearing member after passing through the primary transfer portion also occurs concurrently. In other words, as illustrated in FIG. 10, when an electric discharge occurs downstream of the primary transfer portion T1, the positive charge is absorbed to the surface of the photosensitive drum 1. Downstream, a charged bias of negative polarity is applied to a charging roller 2 as a charging member to absorb the negative charge from the charging roller 2 to the photosensitive drum 1 in order to charge the surface of the photosensitive drum 1 to a predetermined potential. Then, image formation is performed in the following processes: The surface of the photosensitive drum 1 charged to the predetermined potential (the potential of a non-exposed portion) is exposed by an exposure member, not illustrated, to form an electrostatic latent image, and the electrostatic latent image is developed with toner by a developing member, not illustrated.

Here, the photosensitive drum 1 has such characteristics that, when an inner photosensitive layer is exposed, a carrier is generated and the positive charge drifts up to near the drum surface layer, so that an exposed portion becomes at a potential more positive than the non-exposed portion, thereby forming the electrostatic latent image. However, the moving direction of the carrier is restricted by a carrier transport layer formed more on the surface layer side than a carrier generation layer, making it difficult to attenuate the carrier on a base layer side because the carrier passes through the carrier transport layer.

Thus, it is difficult to attenuate the positive charge shot into the surface of the photosensitive drum 1 due to an electric discharge occurring downstream of the primary transfer portion T1. Therefore, a negative charge is supplied by the charging roller 2 to cancel out the positive charge while charging the photosensitive drum 1 uniformly to prepare the surface of the photosensitive drum 1 for subsequent image formation.

However, when the bias to be applied to the primary transfer portion is switched from the ordinary transfer bias to prevent the retransfer of patches as mentioned above, a change is made in the amount of positive charge shot into the surface of the photosensitive drum 1 due to the electric discharge downstream of the primary transfer portion T1. Therefore, even if the surface of the photosensitive drum 1 to which the switched bias is applied is charged by the charging roller 2, the state of the surface potential of the photosensitive drum 1 will vary compared with a case where the ordinary transfer bias is applied. Then, when the surface of the photosensitive drum 1, the surface potential of which has varied, is used to perform the image formation processes such as exposure and development, an image to be formed will be displaced from a desired state.

SUMMARY OF THE INVENTION

The present invention has been made in view of such circumstances to implement a structure capable of reducing the influence on image formation even when a bias to be applied to a primary transfer portion is switched to prevent the retransfer of an adjusting toner image.

The present invention provides an image forming apparatus including: a rotating image bearing member and an intermediate transfer member; a charging member for charging a surface of the image bearing member; an exposure member for exposing the charged image bearing member to form an electrostatic latent image; a developing member for developing, with toner, the electrostatic latent image formed on the surface of the image bearing member; an adjusting toner detection means for detecting an adjusting toner image formed on the surface of the image bearing member; a primary transfer portion in which the toner image formed on the surface of the image bearing member is transferred onto the intermediate transfer member; a bias application member for applying, to the primary transfer portion, a transfer bias when the toner image formed on the surface of the image bearing member is transferred onto the intermediate transfer member, and a passing bias different from the transfer bias when the adjusting toner image formed on the surface of the image bearing member passes through the primary transfer portion, respectively; and a control member for controlling the exposure member not to expose the surface of the image bearing member to which the passing bias is applied.

According to the present invention, since the surface of the image bearing member to which the passing bias is applied is not exposed, the influence on image formation can be reduced even when the bias to be applied to the primary transfer portion is switched to prevent the retransfer of the adjusting toner image.

Further features of the present invention will become apparent from the following description of an exemplary embodiment with reference to the attached drawings.

DESCRIPTION OF THE EMBODIMENT

Figure 1:
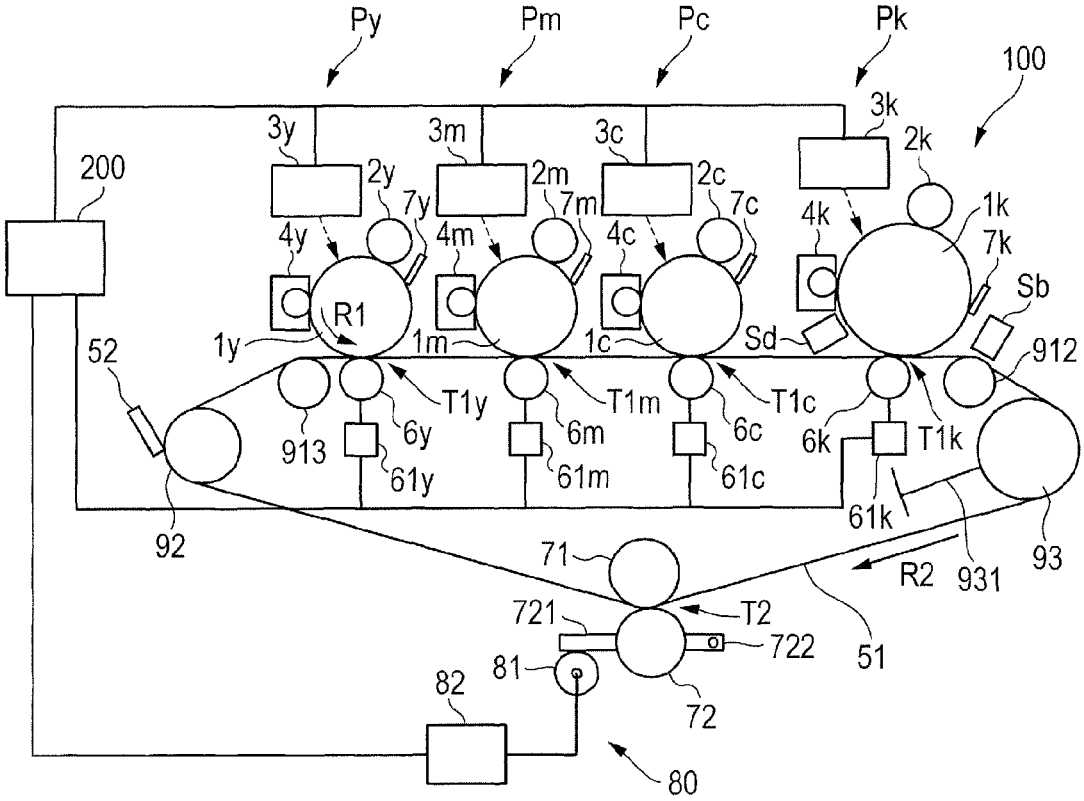
FIG. 1 is a schematic diagram of the structure of an image forming apparatus according to an exemplary embodiment of the present invention.

An exemplary embodiment of the present invention will now be described in detail with reference to FIG. 1 to FIG. 8. First, a schematic structure of an image forming apparatus of the embodiment will be described with reference to FIG. 1.

[Image Forming Apparatus]

An image forming apparatus 100 of the embodiment is a laser beam printer capable of forming a full-color image on a recording material (a recording sheet, an OHP sheet, cloth, or the like) using electrophotography. Such an image forming apparatus 100 has image forming stations Py, Pm, Pc, and Pk for forming yellow, magenta, cyan, and black images, respectively, as image formation means for forming toner images. These image forming stations Py, Pm, Pc, and Pk are lined up in the rotational direction of an intermediate transfer belt 51 as an intermediate transfer member. Thus, the image forming apparatus 100 of the embodiment is a tandem intermediate-transfer type image forming apparatus. In the embodiment, the yellow, magenta, and cyan image forming stations Py, Pm, and Pc correspond to a first image forming station, and the black image forming station Pk corresponds to a second image forming station, respectively.

Note that the basic structures of respective image forming stations are almost the same as one another except for the diameter of the photosensitive drum, toner color used, and the structure for patch detection. Therefore, unless any particular distinction is required, the following will omit the subscripts y, m, c, and k attached to the reference symbol to express for which color the element is provided in order to describe the embodiment as a whole.

A cylindrical photoreceptor, i.e., a photosensitive drum 1, is provided as an image bearing member in an image forming station P. Around the photosensitive drum 1, a charging roller 2 as a charging member and a laser beam scanner 3 as an exposure member are arranged. Also arranged around the photosensitive drum 1 are a developing unit 4 as a developing member and a cleaning unit 7 as a cleaning means.

The intermediate transfer belt 51 is wound among a drive roller 92, a secondary transfer inner roller (inner roller) 71, a follower roller 93, and two idler rollers 912, 913 as multiple supporting members. When a drive force is transmitted to the drive roller 92, the intermediate transfer belt 51 orbits (rotates) in a rotational direction R2 indicated by the arrow. Then, a primary transfer roller (electrode member) 6 as a primary transfer member is arranged on the inner peripheral side of the intermediate transfer belt 51 in a position to face the photosensitive drum 1*y*-1*k* in each image forming station Py-Pk. Each primary transfer roller 6*y*-6*k* presses the intermediate transfer belt 51 toward the photosensitive drum 1*y*-1*k* to form a primary transfer portion (primary transfer nip) T1y-T1k at which the intermediate transfer belt 51 comes into contact with the photosensitive drum 1*y*-1*k*, respectively.

Further, a secondary transfer outer roller (outer roller) 72 as a contact member is arranged in a position to face the inner roller 71 through the intermediate transfer belt 51. The intermediate transfer belt 51 is pinched and held between the inner roller 71 and the outer roller 72 that constitute secondary transfer means, where the inner roller (electrode member) 71 contacts the inner periphery of the intermediate transfer belt 51, and the outer roller contacts the outer periphery of the intermediate transfer belt 51. Thus, a secondary transfer portion T2 is formed.

The outer roller 72 is placed to be able to contact with and separate from the intermediate transfer belt 51. Therefore, the outer roller 72 has a contact/separation device 80 as a contact separation member. The contact/separation device 80 has a cam 81 that abuts against a frame 721 supporting the outer roller 72 to pivot the frame 721 about a pivot shaft 722, and a motor 82 for driving the cam 81 to rotate. The frame 721 is pivoted by the rotation of the cam 81, and this brings the outer roller 72 into contact with or separates the outer roller 72 from the intermediate transfer belt 51. The motor 82 is controlled by a control section 200 serving also as a contact/separation control member. As this contact/separation control member, for example, any other structure such as a solenoid can also be used.

The photosensitive drum 1 is driven to rotate at a predetermined circumferential velocity (process speed) in a direction (counterclockwise direction) indicated by the arrow R1. The surface of the photosensitive drum 1 is charged to a predetermined polarity and potential by the charging roller 2 as a contact charging member (primary charging).

The laser beam scanner 3 outputs an on/off modulated laser beam according to image information input from external equipment such as an image scanner or a computer. Then, the laser beam scanner 3 uses this laser beam to scan and expose the charged surface on the photosensitive drum 1. The scan exposure by the laser beam scanner 3 leads to the formation of an electrostatic latent image on the photosensitive drum 1 according to target image information. This laser beam scanner 3 is controlled by the control section 200 as the control member.

The electrostatic latent image formed on the photosensitive drum 1 is developed as a toner image by the developing unit 4. In the embodiment, the developing unit 4 contains a two-component developer including non-magnetic resin toner particles (toner) and magnetic carrier particles (carrier) as the developer. The developing unit 4 has a developing sleeve as a developer carrying body arranged to face the photosensitive drum 1. Then, toner is supplied from the developer carried on this developing sleeve to the photosensitive drum 1 to develop the electrostatic latent image on the photosensitive drum 1.

The toner image formed on the surface of the photosensitive drum 1 is transferred onto the intermediate transfer belt 51 by the application of a primary transfer bias to each of the primary transfer portions T1y, T1m, T1c, and T1k, respectively. In the embodiment, toner images are electrostatically transferred onto the intermediate transfer belt 51 by means of the primary transfer rollers 6*y*, 6*m*, 6*c*, and 6*k* (primary transfer), respectively. At this time, a proper primary transfer bias is output from power sources 61*y*, 61*m*, 61*c*, and 61*k* as bias application members and applied to the primary transfer rollers 6*y*, 6*m*, 6*c*, and 6*k* as the primary transfer members, respectively. The power sources 61*y* to 61*k* are controlled by the control section 200 serving also as the control member to be able to arbitrarily switch the bias to be applied to the primary transfer rollers 6*y*, 6*m*, 6*c*, and 6*k*. As an example, +900 V is used as the primary transfer bias.

Primary transfer residual toner remaining on the photosensitive drum 1 after the primary transfer process is scraped and collected by the cleaning unit 7. Thus, the surface of the photosensitive drum 1 is cleaned and repeatedly used for image formation.

For example, the above-described operations are sequentially carried out in the first to fourth image forming stations Py-Pk at the time of full-color image formation. The toner image of each color is superimposed and transferred onto the intermediate transfer belt 51 in each primary transfer portion T1y-T1k.

On the other hand, a recording material is conveyed from a recording material supply portion, not illustrated, to the secondary transfer portion T2 in sync with the toner image on the intermediate transfer belt 51. The recording material is supplied to the secondary transfer portion T2 in tune with the toner image on the intermediate transfer belt 51.

The toner image on the intermediate transfer belt 51 is electrostatically transferred onto the recording material by an electric field between the inner roller 71 and the outer roller 72 in the secondary transfer portion T2. Here, a secondary transfer bias can be applied to either the inner roller or the outer roller 72 to form an electric field between these rollers. As an example, 2.3 kV is used as the secondary transfer bias.

After that, the recording material onto which the toner image is transferred in the secondary transfer portion T2 passes through a conveying path, not illustrated, and is conveyed and introduced into a fixing device, not illustrated. Then, the recording material is pressurized and heated in the fixing device so that the toner image will be fixed on the recording material. Secondary transfer residual toner remaining on the intermediate transfer belt 51 after the secondary transfer process is scraped and collected by a cleaning blade 52. Thus, the surface of the intermediate transfer belt 51 is cleaned and repeatedly used for image formation.

In the embodiment, as the intermediate transfer belt 51, a semi-conductive polyimid resin with a relative permittivity $\epsilon$ of 3 to 5, a volume resistivity $\rho v$ of $10^6$ to $10^{11}$ $\Omega$·m, and a thickness of 85 μm is used.

As each of the primary transfer rollers 6*y*, 6*m*, 6*c*, and 6*k*, a semi-conductive roller with a resistance value of $10^2$ to $10^8\Omega$ at the time of application of 2000 V can be used. In the embodiment, as the primary transfer roller 6, an ion-conductive sponge roller with an outer diameter $\phi$ of 18 mm and a cored bar diameter $\phi$ of 8 mm, which is formed of a mixture of nitrile rubber and an ethylene-epichlorohydrin copolymer, is used. The resistance value of the primary transfer roller 6*y*, 6*m*, 6*c*, 6*k* is about $10^6$ to $10^8\Omega$ (applied voltage: 2 kV) at a temperature of 23° C. and a humidity of 50%.

As the inner roller 71, a semi-conductive roller with an outer diameter $\phi$ of 20 mm and a cored bar diameter $\phi$ of 16 mm, in which conductive carbon is dispersed in EPDM rubber, is used. The resistance value of this inner roller 71 is about $10^1$ to $10^5\Omega$ (applied voltage: 10 V) at a temperature of 23° C. and a humidity of 50% by the same measurement method as the above-mentioned method.

As the outer roller 72, an ion-conductive sponge roller with an outer diameter $\phi$ of 24 mm and a cored bar diameter $\phi$ of 12 mm, which is formed of a mixture of nitrile rubber and an ethylene-epichlorohydrin copolymer, is used. The resistance value of this outer roller 72 is about $10^6$ to $10^8\Omega$ (applied voltage: 2 kV) at a temperature of 23° C. and a humidity of 50% by the same measurement method as the above-mentioned method.

Further, in the embodiment, an on-drum patch sensor Sd is placed to face the photosensitive drum 1*k* in the black image forming station Pk, and an on-belt patch sensor Sb is placed to face the intermediate transfer belt 51, respectively. In other words, the on-belt patch sensor Sb as first adjusting toner detection means is arranged downstream of each of the image forming stations Py to Pk as the first image forming station and the second image forming station in the rotational direction of the intermediate transfer belt 51. Then, the on-belt patch sensor Sb detects patches as an adjusting toner image formed on the surface of the intermediate transfer belt 51. The on-drum patch sensor Sd as second adjusting toner detection means detects patches as an adjusting toner image formed on the surface of the photosensitive drum 1*k*.

In the embodiment, the polyimid resin is used as the intermediate transfer belt 51 as mentioned above. However, it is proved that, when a wide variety of recording materials are used, the surface properties of the belt vary. Since fillers such as talc are transferred and attached from the recording material to the belt, the gloss level of the belt may be reduced though there is no change in the surface roughness of the belt. Further, when the intermediate transfer belt 51 is used for a long period in such a state that paper powder is transferred from recording materials and attached thereto, this ends up using the intermediate transfer belt 51 for a long period in such a state that the paper powder is stuck in a nip portion between the cleaning blade 52 and the intermediate transfer belt 51. As a result, if an excess amount of paper powder is supplied, circumferential scratches may occur in the rotational direction of the belt to increase the surface roughness of the belt.

The reduction in the gloss level of the belt or the increase in the surface roughness of the belt may widen the fluctuation range of a sensor for optically detecting the surface of the belt.

Figure 2:
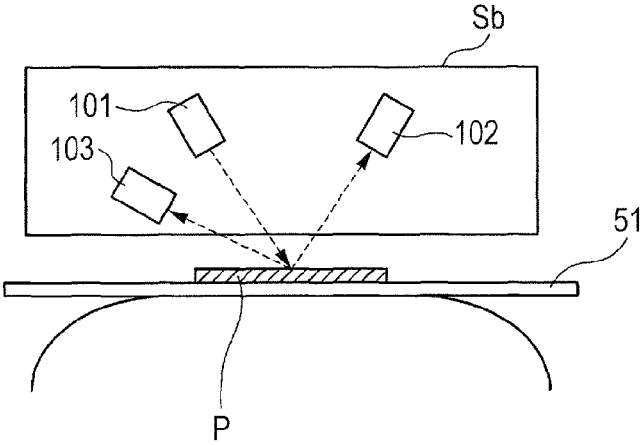
FIG. 2 is a schematic diagram of the structure of a patch sensor.

In the embodiment, the on-belt patch sensor Sb has a structure as illustrated in FIG. 2. In other words, the amount of incident light irradiated from an LED light source 101 is so detected that, among light components reflected by a patch P on the surface of the intermediate transfer belt 51, the amount of reflection of a specular component is detected by a photosensor 102, and the amount of reflection of a diffuse component is detected by a photosensor 103, respectively. The on-belt patch sensor Sb detects the patches of three-color components, yellow, magenta, and cyan. Particularly, when the patch density is detected, a toner density is calculated from a difference between the amount of reflection of a component on the belt surface and the amount of reflection of a component on the patch portion.

As the LED light source 101 of the on-belt patch sensor Sb, an LED (Light Emitting Diode) with a wavelength of 940 nm is used. Since the patch densities of yellow, magenta, and cyan are detected in a visible range, it is preferred that the light source be in a wavelength band where all the above color components are not absorbed.

The structure of the on-drum patch sensor Sd is the same as that of the on-belt patch sensor Sb. However, since the on-drum patch sensor Sd detects the patch of a black color component, the toner density is detected from the diffuse component. As the LED light source of the on-drum patch sensor Sd, an LED with a wavelength of 880 nm is used. Since exposure is performed on the photosensitive drum 1*k*, though only at the time of reading the patch, it is preferred that the on-drum patch sensor Sd be in such a wavelength band that the drum has a low sensitivity when exposure is performed on the photosensitive drum 1, i.e., a near-infrared wavelength band.

The on-drum patch sensor Sd is arranged near the photosensitive drum 1*k* between downstream of the photosensitive drum 1*k* to face the developing sleeve in the rotational direction and upstream of the primary transfer portion T1k. Thus, the detection can be made in the primary transfer portion T1k without disturbing the patches.

In the embodiment, the patches of the three-color components of yellow, magenta, and cyan are read by the on-belt patch sensor Sb. Thus, since the patches of the three-color components are detected on the intermediate transfer belt 51 all at one time, the apparatus main body can be downsized. On the other hand, since the patches of the black color component are read by the on-drum patch sensor Sd, the patches can be detected stably for a long period. This can lead to the stabilization of the toner densities and registration errors for a long period while downsizing the apparatus.

[Operation of Contact/Separation Device in Patch Formation Sequence]

Next, the operation of the contact/separation device 80 in a patch formation sequence will be described. Upon transition from normal imaging to the patch formation sequence, the bias to be applied to the primary transfer portion is switched to perform exposure on an electrostatic latent image corresponding to the patch image. Further, when the patches of the color components of yellow, magenta, and cyan formed on the intermediate transfer belt 51 are supplied to the secondary transfer portion T2, the contact/separation device 80 also releases the pressure on the outer roller 72 to separate the outer roller 72 from the intermediate transfer belt 51. Thus, the contact/separation device 80 avoids contaminating the outer roller 72 with the patches.

Here, as a time period from when the pressure on the outer roller 72 is released until the outer roller 72 is separated from the intermediate transfer belt 51, there is a need to allow for 170 msec. This period also allows for the time to cease the vibration of the intermediate transfer belt 51 when the pressure is released. Thus, the separation itself is achieved in a shorter time than 170 msec.

Further, exposure to electrostatic latent image data corresponding to the black color component is started when 170 msec has elapsed after completion of exposure to a final image before transition from ordinary imaging to the patch formation sequence. At this time, even after completion of exposure to the final image, the rotary drive of the charging roller, the developing sleeve, and the like in the black station and the application of high pressure continue. On the other hand, the outer roller 72 starts releasing the pressure and the separation operation in 30 msec from the timing of completion of secondary transfer of the final image after being subjected to ordinary imaging on a recording material, not illustrated. Since a margin of 30 msec is left, the recording material can be delivered from the secondary transfer portion T2 to the fixing device, not illustrated, without fail to form the final image thereon.

On the other hand, the patches are conveyed to the secondary transfer portion T2 in such a state that the patches are attached onto the intermediate transfer belt 51 in 170 msec from the timing of completion of the formation of the final image. At this moment, the outer roller 72 is separated from the intermediate transfer belt 51. In other words, the patches are conveyed to the secondary transfer portion T2 in a state of waiting until the vibration of the intermediate transfer belt 51 ceases after the outer roller 72 is separated from the intermediate transfer belt 51. This can avoid contaminating the outer roller 72 with the patches.

Thus, in the embodiment, the control section 200 controls the contact/separation device 80 to separate the outer roller 72 from the intermediate transfer belt 51 at timing where the patches transferred onto the intermediate transfer belt 51 reach the secondary transfer portion T2. This can avoid contaminating the outer roller 72 with the patches.

[Black Patch]

Figure 3:
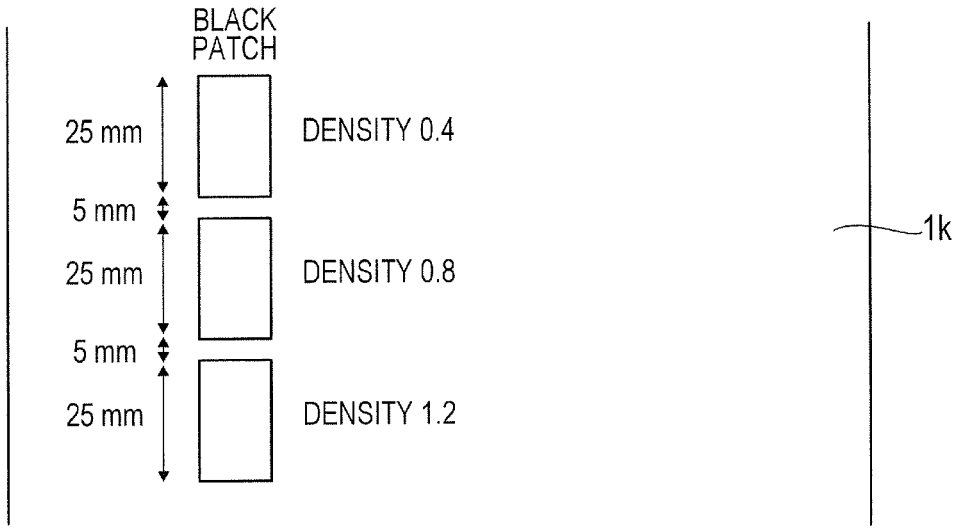
FIG. 3 is a diagram illustrating black patches formed on a photosensitive drum.

The structure of black patches formed on the photosensitive drum 1*k* in the black image forming station Pk is as illustrated in FIG. 3. In the embodiment, patches with density levels of 0.4, 0.8, and 1.2 are formed in series in the rotational direction of the photosensitive drum 1*k*, respectively, and the density of a patch with each density level is detected from the diffuse component of the on-drum patch sensor Sd. In the embodiment, from a comparison between a signal value detected for a patch with each density level of 0.4, 0.8, 1.2 and a signal level corresponding to a predetermined density, the control section 200 controls the laser beam scanner 3*k* to correct the exposure amount in order to perform density correction. For example, the exposure amount is corrected by controlling the laser power or the PWM value.

Here, in the embodiment, it is assumed that the length of each patch in the circumferential direction of the photosensitive drum 1*k* is 25 mm. Further, a spacing of 5 mm is left between the respective density levels of patches. Since the spot diameter of the on-drum patch sensor Sd used in the embodiment is 5 mm, the respective density levels of patches need to be spaced at an interval corresponding to the spot diameter or more so that adjacent density levels of patches will not read at the same time. It is also desired that plural points be read in each density-level patch and the read points be averaged to improve the detection accuracy of the patch density. To this end, in the embodiment, the patch length is set to 25 mm as mentioned above to detect the densities at four points in each patch and average the densities to improve the accuracy.

Here, in the embodiment, the outer diameter of the photosensitive drum 1*k* for black is 30 mm. Since a cycle of the photosensitive drum 1*k* in the circumferential direction is about 94 mm, a total length of the above-mentioned three density levels of toner patches together with spaces between adjacent patches is 25 mm×3+5 mm×2=85 mm, which can fall within one cycle of the drum.

[Patches for Yellow, Magenta, and Cyan]

Figure 4:
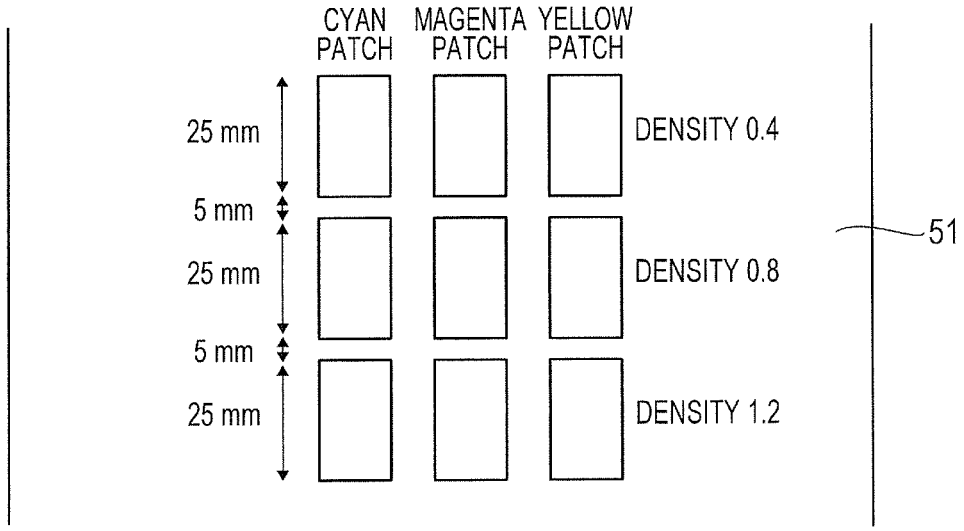
FIG. 4 is a diagram illustrating yellow, magenta, and cyan patches formed on an intermediate transfer belt.
Figure 5:
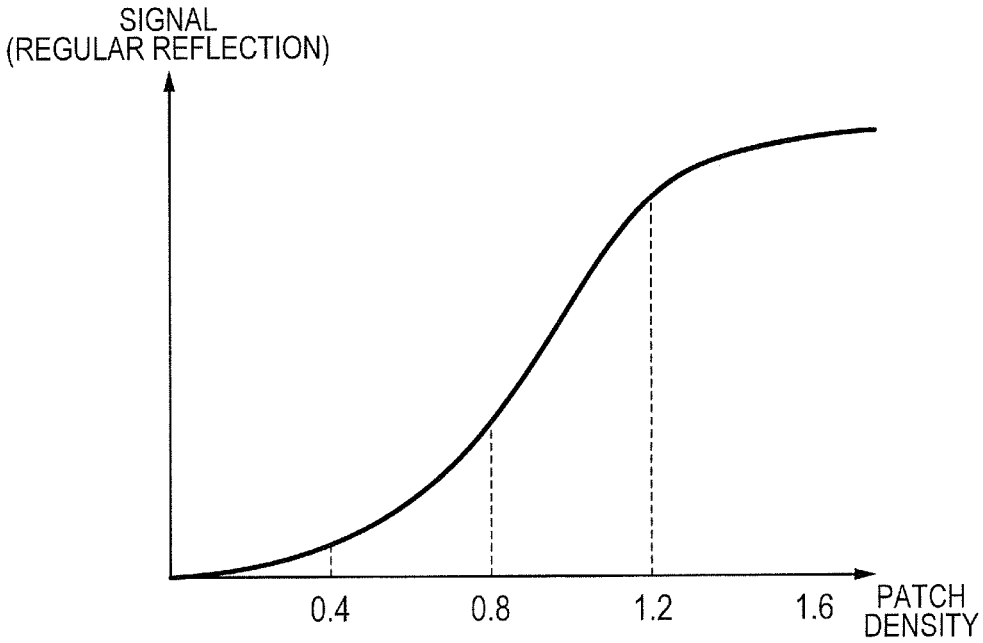
FIG. 5 is a chart illustrating the relationship between a patch density and a patch sensor signal.

On the other hand, patches of respective color components for yellow, magenta, and cyan formed on the intermediate transfer belt 51 are as illustrated in FIG. 4. When a patch density is optically detected, the amount of specular reflection is reduced as the density of a patch is thickened. A relationship between the patch density and a signal of the on-belt patch sensor Sb (the same applies to the on-drum patch sensor Sd) is illustrated in FIG. 5. In FIG. 5, the abscissa axis represents the patch density and the ordinate axis indicates, as a signal, a difference between the amount of specular reflection on the surface of the intermediate transfer belt and the amount of specular reflection upon patch detection. From FIG. 5, a saturation behavior in which the signal does not linearly increase even when the patch density level is increased is seen in a high-density region that exceeds a region of a certain level of density. The reason for this is considered as follows. Namely, toner particles are layered on the drum or the belt according to an electrostatic latent image to form toner images. To increase the density, more toner is layered, and two or more layers are superimposed. In this case, no large fluctuation appears in terms of the amount of reflected light.

On the other hand, even in the case of very low-density levels of patches, the linearity of the signal with respect to the patch density is low. The reason for this is considered as follows. Namely, when toner is layered according to an electrostatic latent image to form very low-density levels of patches, toner particles are only sparsely placed, and the amount of reflected light is detected on the order of a few millimeters as the detection range of the patch sensor. Therefore, in the case of the on-belt patch sensor Sb, it is affected by the surface of the belt.

For the above reasons, in the high-density region, in which the signal value with respect to the patch density is saturated and the linearity is impaired, and in the very low-density region, the accuracy of density detection with respect to the patch density is reduced. Therefore, in the embodiment, three patch density levels of 0.4, 0.8, and 1.2 are targeted. As illustrated in FIG. 4, three different density levels of patches for yellow, magenta, and cyan, located in different positions in the width direction of the belt that intersects the rotational direction, are detected all at one time. The length of and interval between patches are the same as the case of black patches. Such patches for yellow, magenta, and cyan are formed in a position off the black patches in the width direction of the photosensitive drum 1*k* and the intermediate transfer belt 51. The timing at which the yellow, magenta, and cyan patches pass through the primary transfer portion T1k is the same as the timing at which the black patches pass through the primary transfer portion T1k. Thus, the yellow, magenta, and cyan patches pass through a non-exposed portion of the black photosensitive drum 1*k*.

Further, the on-belt patch sensor Sb is provided with an unillustrated independent detection section for each color component of yellow, magenta, and cyan, and this can lead to simultaneous detection of three-color patches. Since the respective color components are detected simultaneously, the downtime of the main body to perform density correction for four colors including black can be minimized.

In the embodiment, from a comparison between a signal value detected for a patch with each density level of 0.4, 0.8, 1.2 and a signal level corresponding to a predetermined density, the control section 200 controls each of the laser beam scanners 3*y*, 3*m*, and 3*c* to correct the exposure amount. Then, as mentioned above, patch density correction is performed. For example, the exposure amount is corrected by controlling the laser power or the PWM value.

In the embodiment, since the patch sensor is not provided near the drum in each of the stations for yellow, magenta, and cyan, the structure around the photosensitive drum can be simplified, achieving reduction in the diameter of the photosensitive drum and downsizing of the main body.

[Switching of Biases to be Applied to Primary Transfer Portion]

Next, switching of biases to be applied to the primary transfer portion in the patch formation sequence will be described. In the embodiment, when patches of three-color components for yellow, magenta, and cyan pass through the primary transfer portion T1k in the black image forming station Pk, the bias to be applied to the primary transfer portion T1k is switched from ordinary transfer bias. In this case, although the patches of the black color component also pass through the primary transfer portion T1k at the same time, since the black patches are detected by the on-drum patch sensor Sd, there is no need to transfer the black patches onto the intermediate transfer belt 51. Then, the influence of toner retransfer of the patches, formed in the upstream image forming stations Py, Pm, and Pc, on the density is prevented. In the following, it is assumed that the bias to be applied to the primary transfer portion T1k in an ordinary imaging sequence is an ordinary bias (transfer bias), and that the bias to be applied to the primary transfer portion T1k when the patches pass through the primary transfer portion T1k to prevent the retransfer of the patches is a passing bias.

In other words, in the embodiment, the power source 61*k* switches the bias to be applied to the primary transfer portion T1k between the ordinary bias and the passing bias different from the ordinary bias. The ordinary bias is applied when the toner image formed on the surface of the photosensitive drum 1*k* is transferred onto the intermediate transfer belt 51. The passing bias is applied when the patches formed in the upstream image forming stations Py, Pm, and Pc and transferred onto the intermediate transfer belt 51 and the patches formed on the surface of the photosensitive drum 1*k* pass through the primary transfer portion T1k. If only the black patches are formed, the passing bias will be applied when the patches formed on the surface of the photosensitive drum 1*k* pass through the primary transfer portion T1k.

In the embodiment, the potential of the non-exposed portion of the photosensitive drum 1*k* (the potential of a portion on the surface of the photosensitive drum 1*k* that is charged by the charging roller 2*k* but not exposed) is set to −700 V both in the ordinary imaging sequence and upon patch formation. As a developing bias, a bias obtained by superimposing an AC component on a DC component is applied for the purpose of improving development efficiency. In this case, the DC component is set to −600 V. Thus, the potential of the DC component in the developing unit 4*k* is set to a potential about 100 V more positive than the potential of the non-exposed portion of the photosensitive drum 1*k* to effectively prevent the adhesion of developer onto the non-exposed portion (fogging). Further, together with this, an excessively large potential difference is avoided to enable prevention of the adhesion of carrier in the non-exposed portion.

Figure 6:
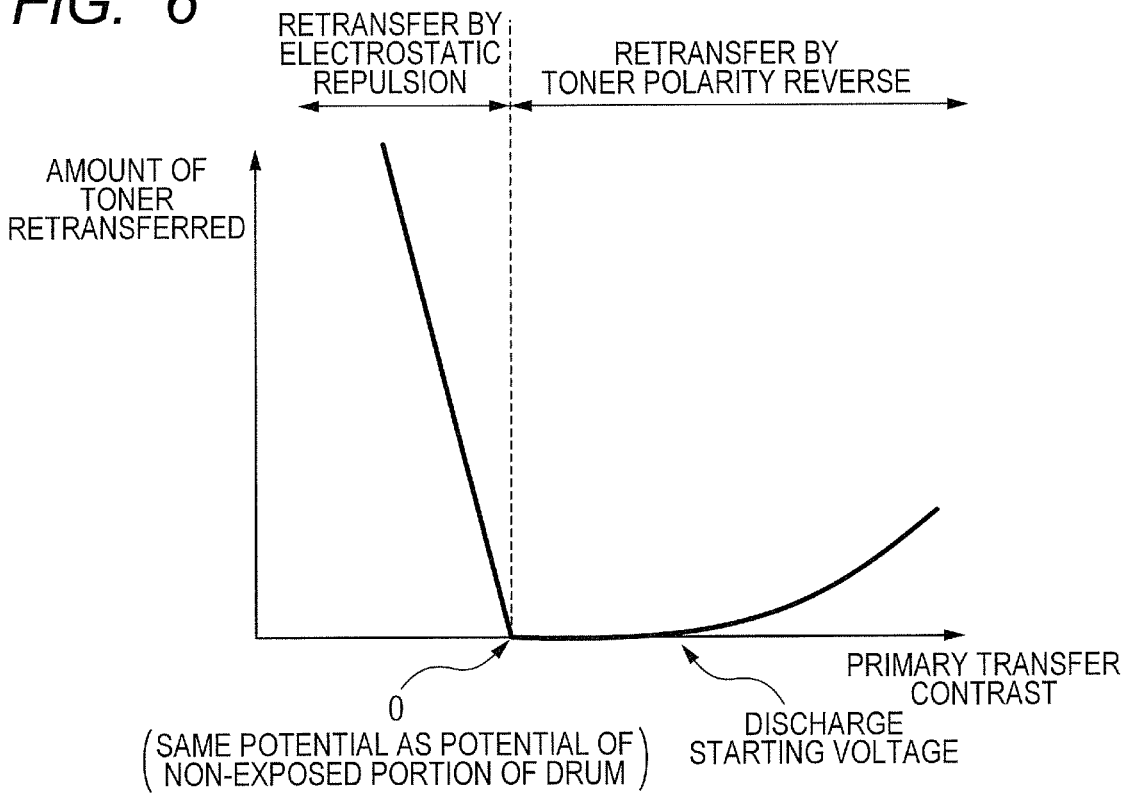
FIG. 6 is a chart illustrating the relationship between a primary transfer contrast and the amount of retransferred toner.

Here, as illustrated in FIG. 6, a primary transfer contrast potential as a potential difference between the bias to be applied to the primary transfer roller and the potential of the non-exposed portion of the photosensitive drum does not fall below zero, and the primary transfer roller does not have an excessively large potential difference on the positive polarity side, enabling effective prevention of retransfer. In the embodiment, as mentioned above, the bias to be applied to the primary transfer portion T1k in the black image forming station Pk is +900 V in the ordinary imaging sequence, but the passing bias is switched to −600 V identical to the DC component of the developing bias.

Since the potential of the non-exposed portion of the photosensitive drum 1*k* is −700 V, the primary transfer contrast is +1600 V upon ordinary imaging, while the passing bias has a small potential difference of +100 V. This can avoid an electric discharge in the primary transfer portion T1k to effectively prevent toner retransfer due to the positive reverse of patches such as yellow patches passing therethrough. On the other hand, the primary transfer contrast is not on the negative polarity side, and this can effectively avoid retransfer due to electrostatic repulsion. Thus, the retransfer of yellow, magenta, and cyan patches when passing through the black primary transfer portion T1k can be effectively prevented. Here, as mentioned above, since there is no need to transfer the black patches onto the intermediate transfer belt 51 in the primary transfer portion T1k, the passing bias can be reduced as mentioned above.

Thus, in the embodiment, when the reverse polarity (positive polarity) is greater than the same polarity (negative polarity) as the toner charging polarity, the passing bias is set higher than the potential of the non-exposed portion and lower than the ordinary bias. In other words, the passing bias is so set that the primary transfer contrast as a potential difference from the potential of the non-exposed portion will be on the positive polarity side and sufficiently smaller than a primary transfer contrast on the ordinary bias. Specifically, as mentioned above, the potential of the non-exposed portion is set to −700 V, the passing bias to be applied to the primary transfer roller 6*k* is set to −600 V, and the ordinary bias is set to +900 V.

[Timing of Switching Bias to be Applied to Primary Transfer Portion]

In the embodiment, switching from the bias to be applied to the primary transfer portion T1k (primary transfer roller 6*k*) to the passing bias is started in 150 msec from the timing at which the final image after being subjected to ordinary imaging passes through the primary transfer portion T1k. Since the patches are brought to the primary transfer portion T1k when 200 msec has elapsed after the final image passed through, the bias to be applied to the primary transfer portion T1k is switched to the passing bias when the patches pass through. Here, it must make sure that the bias is switched when the patches pass through. Therefore, in the embodiment, the bias is switched ahead with 50 msec left as a margin to stabilize high-voltage output.

[Transition Between Ordinary Imaging and Patch Formation Sequence]

Figure 7:
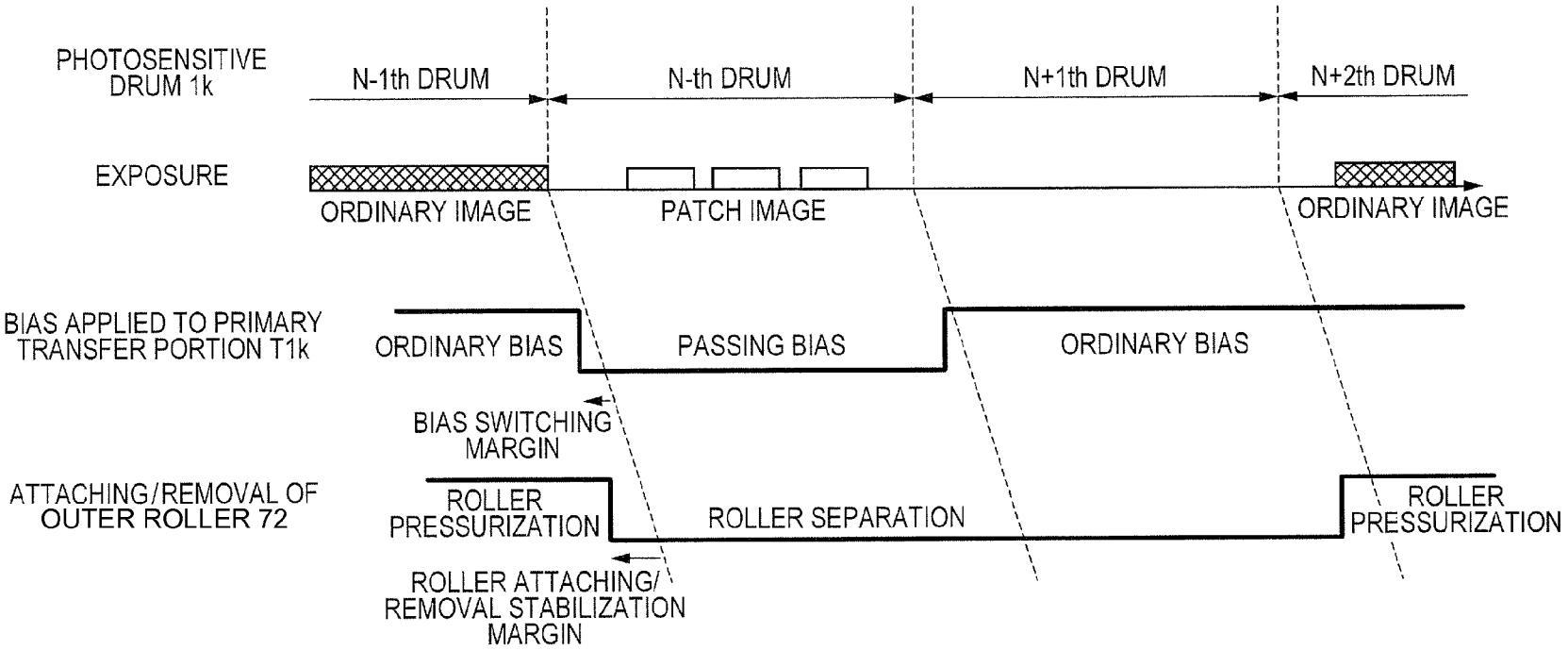
FIG. 7 is a time chart illustrating the state of a transition between an ordinary imaging sequence and a patch formation sequence in the embodiment.

Referring next to FIG. 7, a switching sequence for a transition from ordinary imaging to the patch formation sequence will be described. In the embodiment, as mentioned above, since the black patches are detected by the on-drum patch sensor Sd, there is no need to transfer the black patches onto the intermediate transfer belt 51. Therefore, the passing bias when the yellow, magenta, and cyan patches pass through the black primary transfer portion T1k can be made sufficiently small with respect to the ordinary bias. On the other hand, the drum surface to which such a passing bias to be sufficiently small compared with the ordinary bias is applied substantially differs in the surface potential state from the drum surface to which the ordinary bias is applied. If imaging is performed by using the drum surface to which the passing bias is applied, an image to be formed will be displaced from a desired state.

Therefore, in the embodiment, the control section 200 controls the laser beam scanner 3*k* not to expose the surface of the photosensitive drum 1*k* to which the passing bias is applied. To this end, in the embodiment, exposure is performed to form the patches in the N-th cycle of the photosensitive drum 1*k* after ordinary imaging of the final image is performed in the N−1-th cycle of the photosensitive drum 1*k* as illustrated in FIG. 7. Along with this, the bias to be applied to the primary transfer roller 6*k* is switched from the ordinary bias to the passing bias when the patches reach the primary transfer portion T1k. Further, the outer roller 72 is switched from a pressurized state to a separated state when the patches reach the secondary transfer portion T2.

Then, the patches are not formed in the N+1-th cycle of the photosensitive drum 1*k* after the patches pass through. Note that the bias to be applied to the primary transfer roller 6*k* is switched from the passing bias to the ordinary bias. In other words, the power source 61*k* switches from the passing bias to the ordinary bias after one cycle of the photosensitive drum 1*k* since the bias to be applied to the primary transfer roller 6*k* is switched from the ordinary bias to the passing bias. Then, the control section 200 controls the laser beam scanner 3*k* to perform exposure after one cycle of the photosensitive drum 1*k* since the passing bias is switched from the passing bias to the ordinary bias.

This enables use of the drum surface applied with the ordinary bias in ordinary imaging restarting from the N+2-th cycle of the photosensitive drum 1*k*. In other words, in the ordinary imaging restarting from the N+2-th cycle, the photosensitive drum 1*k* can be put into a state under conditions equivalent to the ordinary imaging.

This operation will be specifically described below. In the embodiment, distance from a position where image information is exposed to the primary transfer portion T1k (central nip portion) on the black photosensitive drum 1*k* in the rotational direction of the photosensitive drum 1*k* is 38 mm. Further, the rotating speed of the photosensitive drum 1*k* is 348 mm/sec. The timing of switching the bias to be applied to the photosensitive drum 1*k* from the ordinary bias to the passing bias in the wake of completion of ordinary image exposure just before the transition to the patch formation sequence is determined as follows.

The time of the rotation of the photosensitive drum from the exposure position on the surface of the photosensitive drum 1*k* to the primary transfer position T1k is about 109 msec. On the other hand, as mentioned above, the timing of start of switching the bias to be applied to the primary transfer roller 6*k* is in 150 msec after the ordinary image passes through the primary transfer portion T1k. Therefore, switching of the bias to be applied to the primary transfer roller 6*k* is in 259 msec after the timing of completion of the exposure.

On the other hand, the patches start in 170 msec after completion of the exposure of the final image. Therefore, the patches are brought to the primary transfer portion T1k in 20 msec after the bias to be applied to the primary transfer roller 6*k* is switched, i.e., 6.96 mm in terms of the length in the conveying direction. Since the length of the patches including the interval between patches is 85 mm as mentioned above, a total length is 85+6.96=91.96 mm in consideration of a margin of switching biases. This is shorter than 94 mm as the length of the outer circumference of the photosensitive drum 1*k* corresponding to one cycle, falling within one cycle of the photosensitive drum 1*k*. Thus, in the embodiment, when the transfer bias is applied for one cycle or more before the bias is switched to the passing bias, one cycle of the photosensitive drum 1*k* including the margin of switching biases at the time of switching to the passing bias can be used for patch formation.

In this case, the entire circumferential surface is exposed to the ordinary bias at the time of switching to the passing bias. Therefore, if the exposure timing for patch formation is so set that the patches can be formed by using the entire circumference at the time of switching to the passing bias, the patches can be formed on the surface exposed to the ordinary bias with less loss of time. Then, even at the time of patch formation, the photosensitive drum 1*k* can be put into the same state as the photosensitive drum 1*k* at the time of ordinary imaging. Thus, it is preferred that patch formation be completed during one cycle of the photosensitive drum 1*k* after the bias to be applied to the primary transfer roller 6*k* is switched to the passing bias.

Figure 8:
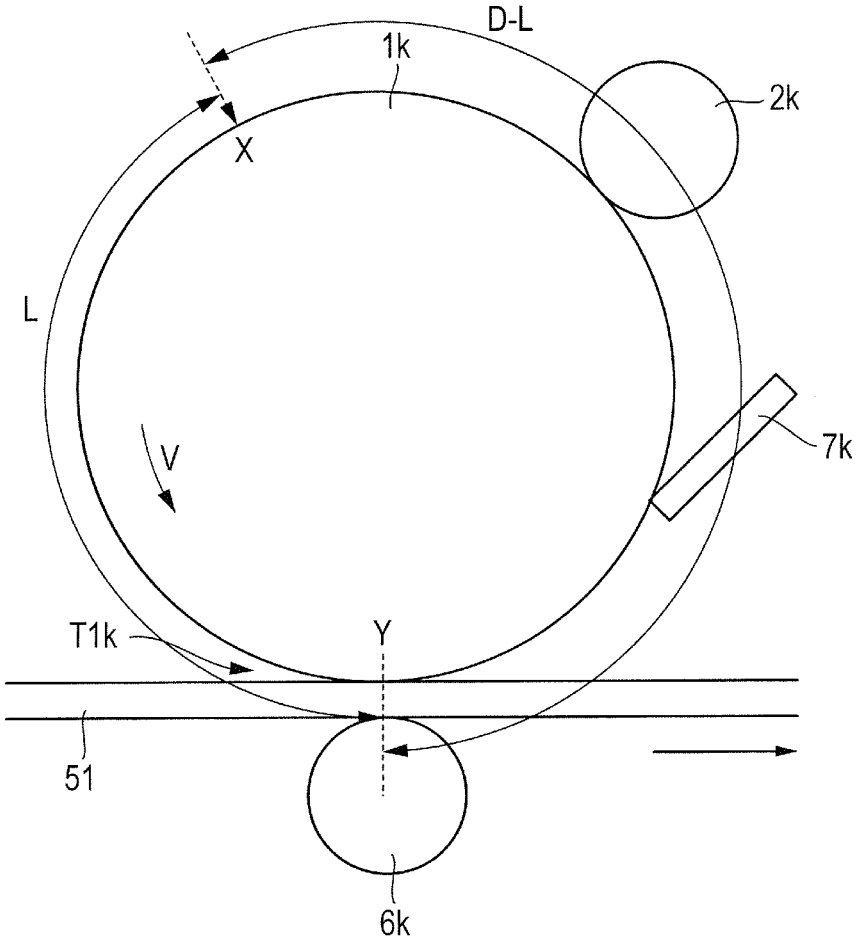
FIG. 8 is a schematic diagram illustrating a structure around a black photosensitive drum with a part thereof omitted.
Figure 9:
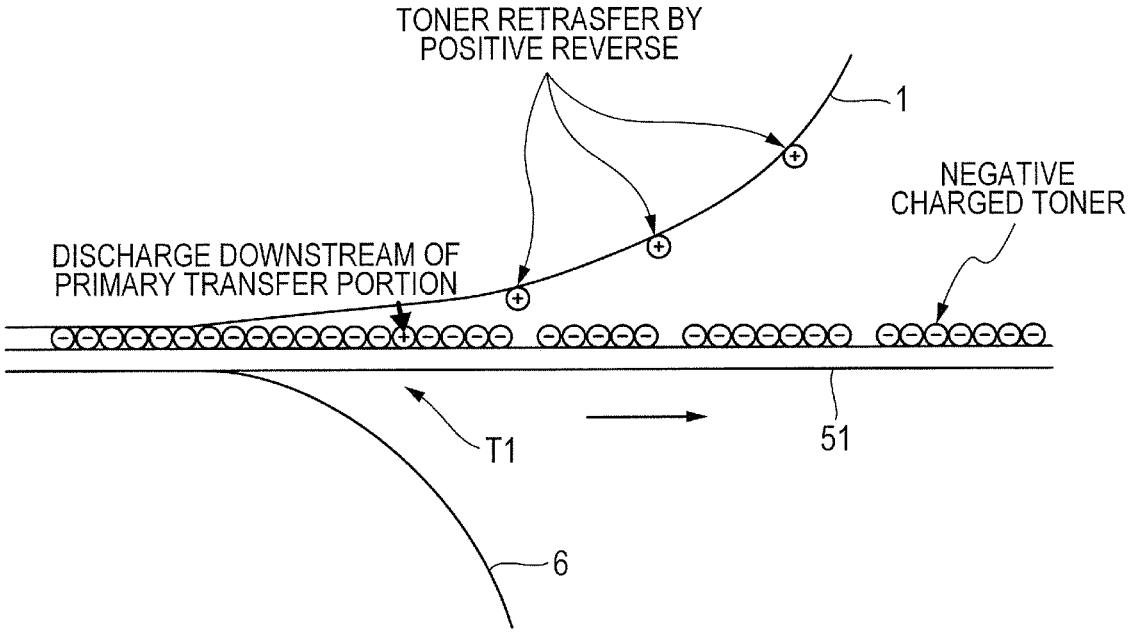
FIG. 9 is a schematic diagram near a primary transfer portion to describe a retransfer mechanism.
Figure 10:
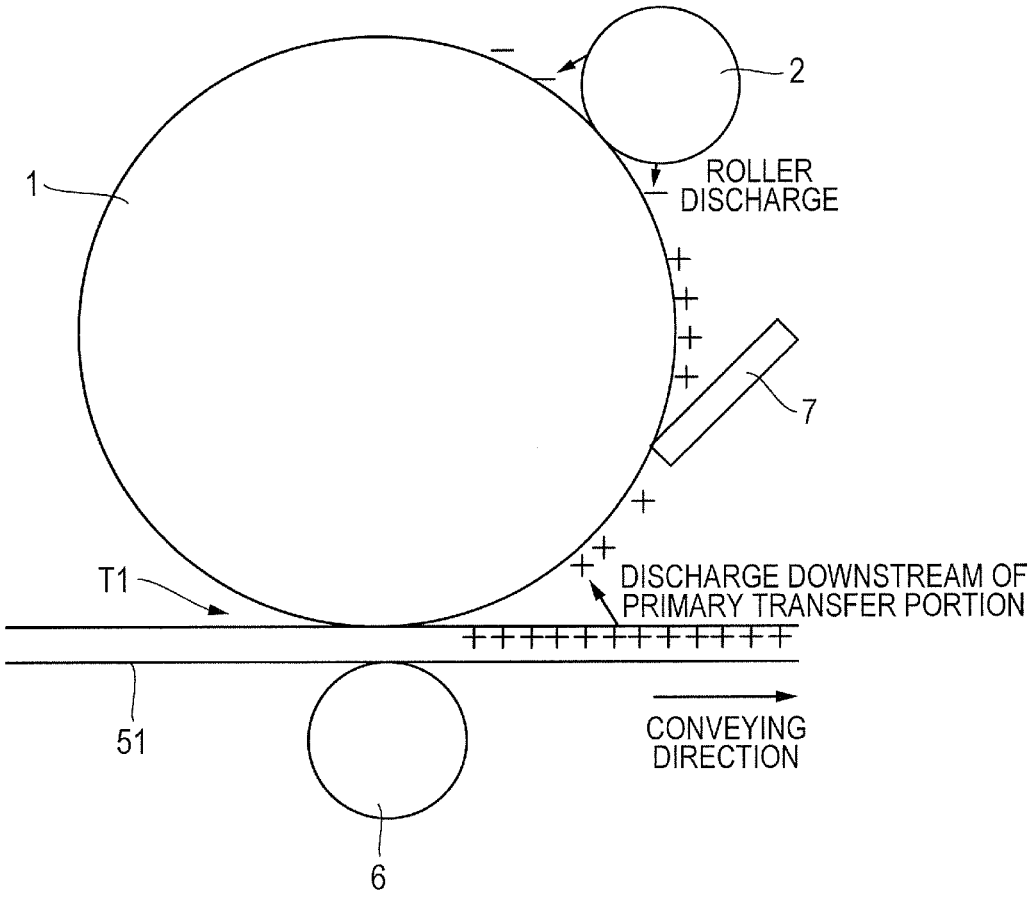
FIG. 10 is a schematic diagram illustrating the states of charges on the surface of the photosensitive drum from the primary transfer portion to a charging roller.

To this end, the following conditions need to be met. Namely, as illustrated in FIG. 8, the length from an exposed position X on the surface of the photosensitive drum 1*k* to a nip center Y of the primary transfer portion T1k in the rotational direction is denoted by L, the rotating speed of the photosensitive drum 1*k* is denoted by V, and the entire circumferential length of the surface of the photosensitive drum 1*k* is denoted by D. Further, it is assumed that timing at which the bias to be applied to the primary transfer roller 6*k* is switched from the ordinary bias to the passing bias is set to a start reference time and the ordinary bias is applied across the entire circumferential surface of the photosensitive drum 1*k* at the start reference time. In this case, the control section 200 controls the laser beam scanner 3*k* not to perform exposure to form the patches at a timing of L/V or earlier than the start reference time and at a timing of (D−L)/V or later than the start reference time.

When exposure is performed at the timing of L/V or earlier than the start reference time, the patches formed by the exposure reach the primary transfer portion T1k before switching to the passing bias. On the other hand, when exposure is performed at the timing of (D−L)/V or later than the start reference time, the exposure is performed on the surface exposed to the passing bias. If the above-mentioned conditions are met, the bias will be already switched to the passing bias when the patches pass through the primary transfer portion T1k. Thus, the surface on which exposure is performed for patch formation becomes the surface exposed to the ordinary bias.

On the other hand, in a transition from the patch formation sequence to ordinary imaging, the following conditions just have to be met: First, it is assumed that timing at which the bias to be applied to the primary transfer roller 6*k* is switched from the passing bias to the ordinary bias is set to an end reference time. In this case, the control section 200 controls the laser beam scanner 3*k* to perform exposure on the surface of the photosensitive drum 1*k* at a timing of (D−L)/V or later than the previous end reference time. As a result, the surface on which exposure is performed to form an ordinary image becomes the surface exposed to the ordinary bias. If exposure is performed to form the ordinary image when (D−L)/V has elapsed from the end reference time, ordinary imaging can be started without waiting for one cycle of the photosensitive drum 1*k* as mentioned above, so that the loss of time can further be reduced, thereby improving productivity. In practice, it is preferred that exposure be started at timing where a predetermined margin is added to the time when (D−L)/V has elapsed from the end reference time. If exposure can be started at least before one cycle of the photosensitive drum 1*k* after (D−L)/V has elapsed from the end reference time, the productivity can be improved.

As mentioned above, in the embodiment, the surface of the photosensitive drum 1*k* to which the passing bias is applied is not exposed, i.e., not used for image formation. Therefore, even if the bias to be applied to the primary transfer roller 6*k* is switched to prevent the retransfer of the patches, the influence on image formation can be reduced. In other words, in the above-mentioned sequences, imaging can be performed both in the sequence of patch formation under the condition of high primary transfer voltage to be applied to the photosensitive drum 1*k* and when ordinary imaging is restarted after returning from the patch formation time.

Thus, in the embodiment, multicolor patches such as yellow are detected on the intermediate transfer belt 51 all at one time, and in the structure for detecting the black patches on the photosensitive drum 1*k* concurrently, the retransfer of the multicolor patches onto the photosensitive drum 1*k* can be prevented effectively. This can improve the detection accuracy of the multicolor patches. Further, since imaging at the time of formation of black patches can be performed under the conditions equivalent to those in the ordinary imaging sequence, the detection accuracy of the black patches can also be improved. This can lead to stable patch detection for a lengthy period, and hence there can be provided a multicolor image forming apparatus excellent in density stability and color-shifting stability.

In the above, the present invention has been described along the specific embodiment, but the present invention is not limited to the aforementioned embodiment. For example, in the aforementioned embodiment, the on-drum patch sensor Sd is arranged upstream of the primary transfer portion T1k. However, there is a case where it is difficult to save a space for the on-drum patch sensor Sd between the developing unit 4*k* and the primary transfer portion T1k. In this case, the on-drum patch sensor Sd can be arranged downstream of the primary transfer portion T1k and upstream of the cleaning unit 7*k*.

While the embodiment of the present invention has been described, the present invention is not intended to be limited to the aforementioned embodiment, and any modification is possible within the technical concept of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-103005, filed Apr. 27, 2012, which is hereby incorporated by reference herein in its entirety.

What is claimed is:

1. An image forming apparatus comprising:

a rotating image bearing member and an intermediate transfer member;

charging member for charging a surface of the image bearing member;

exposure member for exposing the charged image bearing member to form an electrostatic latent image;

developing member for developing, with toner, the electrostatic latent image formed on the surface of the image bearing member;

adjusting toner detection means for detecting an adjusting toner image formed on the surface of the image bearing member;

a primary transfer portion in which the toner image formed on the surface of the image bearing member is transferred onto the intermediate transfer member;

bias application member for applying, to the primary transfer portion, a transfer bias when the toner image formed on the surface of the image bearing member is transferred onto the intermediate transfer member, and a passing bias different from the transfer bias when the adjusting toner image formed on the surface of the image bearing member passes through the primary transfer portion, respectively; and control member for controlling the exposure member not to expose the surface of the image bearing member to which the passing bias is applied.

2. The image forming apparatus according to claim 1, wherein, when a length from a position exposed by the exposure member on the surface of the image bearing member to the primary transfer portion in the rotational direction is denoted by L, a rotating speed of the image bearing member is denoted by V, and a length of an entire circumferential surface of the image bearing member is denoted by D, and when the transfer bias is applied across the entire circumferential surface of the image bearing member at a start reference time set as timing of switching the bias to be applied to the primary transfer portion from the transfer bias to the passing bias, the control member controls the exposure member not to perform exposure to form the adjusting toner image at a timing of L/V or earlier than the start reference time and at a timing of (D−L)/V or later than the start reference time.

3. The image forming apparatus according to claim 1, wherein when a length from a position exposed by the exposure member on the surface of the image bearing member to the primary transfer portion in a rotational direction is denoted by L, a rotating speed of the image bearing member is denoted by V, and a length of an entire circumferential surface of the image bearing member is denoted by D, and when timing of switching a bias to be applied to the primary transfer portion from the passing bias to the transfer bias is set as an end reference time, the control member controls the exposure member to perform exposure on the surface of the image bearing member at a timing of (D−L)/V or later than the previous end reference time.

4. The image forming apparatus according to claim 1, wherein the bias application member switches from the passing bias to the transfer bias after one cycle of the image bearing member since the bias to be applied to the primary transfer portion is switched from the transfer bias to the passing bias, and the control member controls the exposure member to perform exposure after one cycle of the image bearing member since the passing bias is switched to the transfer bias.

5. The image forming apparatus according to claim 1, wherein when a reverse polarity is greater than a polarity identical to a toner charging polarity, the passing bias is set higher than a potential of a non-exposed portion on the surface of the image bearing member, which is charged by the charging member but not exposed, and lower than the transfer bias.

6. The image forming apparatus according to claim 1, further comprising:

a contact member coming into contact with the intermediate transfer member in a secondary transfer portion in which a toner image formed on the intermediate transfer member is transferred onto a recording material;

contact separation member for bring the contact member into contact with and separating the contact member from the intermediate transfer member; and contact/separation control member for controlling the contact separation member to separate the contact member from the intermediate transfer member at timing where the adjusting toner image transferred onto the intermediate transfer member reaches the secondary transfer portion.

7. An image forming apparatus comprising:

a rotating intermediate transfer member;

a first image forming station and a second image forming station lined up in the rotational direction of the intermediate transfer member, wherein the second image forming station is arranged downstream of the first image forming station in the rotational direction of the intermediate transfer member, and each of the first image forming station and the second image forming station includes a rotating image bearing member, charging member for charging a surface of the image bearing member, exposure member for exposing the charged image bearing member to form an electrostatic latent image, developing member for developing, with toner, the electrostatic latent image formed on the surface of the image bearing member, and a primary transfer portion in which a toner image formed on the surface of the image bearing member is transferred onto the intermediate transfer member;

first adjusting toner detection means arranged downstream of the first image forming station and the second image forming station in the rotational direction of the intermediate transfer member to detect an adjusting toner image formed on the surface of the intermediate transfer member;

second adjusting toner detection means provided in the second image forming station to detect an adjusting toner image formed on the surface of the image bearing member in the second image forming station;

bias application member for applying, to the primary transfer portion of the second image forming station, a transfer bias when the toner image formed on the surface of the image bearing member in the second image forming station is transferred onto the intermediate transfer member, and applying a passing bias different from the transfer bias when the adjusting toner image formed in the first image forming station and transferred onto the intermediate transfer member and the adjusting toner image formed on the surface of the image bearing member in the second image forming station pass through the primary transfer portion of the second image forming station, respectively; and control member for controlling the exposure member in the second image forming station not to expose the surface of the image bearing member in the second image forming station to which the passing bias is applied.

* * * * *